US005778841A

United States Patent [19]

Reedy et al.

[11] Patent Number: 5,778,841

[45] Date of Patent: Jul. 14, 1998

[54] CAMSHAFT FOR INTERNAL COMBUSTION ENGINES

[75] Inventors: Steven W. Reedy, Nashville; Rand D. Klopfer, Indianapolis, both of Ind.; Randal L. Myers, Randolph, N.Y.

[73] Assignee: Cummins Engine Company, Inc., Columbus, Ind.

[21] Appl. No.: 806,207

[22] Filed: Feb. 26, 1997

[51] Int. Cl.[6] ..... F01L 1/04; F01M 9/10

[52] U.S. Cl. ..... 123/90.34; 123/90.6; 74/567; 184/6.9

[58] Field of Search ..... 123/90.33, 90.34, 123/90.6, 196 R, 196 M; 74/567; 184/6.5, 6.9

[56] References Cited

U.S. PATENT DOCUMENTS

| | | | |
|---|---|---|---|
| 1,469,063 | 9/1923 | Wills | 184/6.9 |
| 4,072,448 | 2/1978 | Loyd, Jr. | 418/60 |
| 4,430,968 | 2/1984 | Futakuchi et al. | 123/90.34 |
| 4,441,465 | 4/1984 | Nakamura | 123/90.34 |
| 4,565,168 | 1/1986 | Rivere | 123/90.34 |
| 4,876,916 | 10/1989 | Maier | 74/567 |
| 4,942,855 | 7/1990 | Muto | 123/90.33 |
| 4,949,683 | 8/1990 | Swars | 123/90.34 |
| 4,957,079 | 9/1990 | Nakatani et al. | 123/90.34 |
| 5,143,034 | 9/1992 | Hirose | 123/90.34 |
| 5,150,675 | 9/1992 | Murata | 123/90.34 |
| 5,186,129 | 2/1993 | Magnan et al. | 123/90.34 |
| 5,201,247 | 4/1993 | Maus et al. | 74/567 |
| 5,273,007 | 12/1993 | Ampferer | 123/90.34 |
| 5,404,845 | 4/1995 | Hannibal et al. | 123/90.34 |

*Primary Examiner*—Weilun Lo

*Attorney, Agent, or Firm*—Sixbey Friedman Leedom & Ferguson, Jr.; Charles M. Leedom, Jr.

[57] ABSTRACT

A high strength, lightweight camshaft for an internal combustion engine, comprising a shaft body having an axially oriented hollow interior extending a predetermined length from between a pair of spaced points, respectively, adjacent the ends of the shaft body. Plural camshaft journal bearings are spaced apart on the shaft body and include a pair of end camshaft journal bearings positioned adjacent the ends of the shaft body, respectively, with at least one inner camshaft journal bearing positioned intermediate the pair of end camshaft journal bearings. Each end camshaft journal bearing has a lubricant transfer means formed therein for receiving lubricant from an external supply and for transferring lubricant into the hollow interior of the camshaft. At least one radial hole is formed in the shaft body for providing lubricant from the hollow interior to an inner camshaft journal bearing wherein the lubricant transfer means associated with the pair of end camshaft journals provides at least two paths for lubricant to flow into the hollow interior of the camshaft for providing an even distribution of lubrication to each inner camshaft journal bearing during operation of the internal combustion engine. A supply of lubricant always remains in the camshaft to assist in lubricating the camshaft journal bearings during engine start-up.

28 Claims, 6 Drawing Sheets

CAMSHAFT FOR INTERNAL COMBUSTION ENGINES

TECHNICAL FIELD OF THE INVENTION

The present invention relates to a camshaft for an internal combustion engine and more particularly, to a hollow camshaft for reducing the overall weight of an engine and effectively supplying lubricant to camshaft journal bearings.

BACKGROUND OF THE INVENTION

In an effort to remain competitive, engine manufacturers are continuously seeking ways to improve the efficiency and reliability of their engine products without compromising performance. Through research and innovation, manufacturers are continuously attempting to reduce manufacturing costs, yet provide the customer with a reliable and efficient product that meets or exceeds their needs. A known technique for achieving greater efficiency, especially in engines used in over-the-road vehicles, is to reduce the weight of such engines. Such weight reduction can lead to greater fuel efficiency, reduced tire wear, and other reduced costs associated with manufacture and use of the engine product.

The camshaft of an internal combustion engine has evolved through the years to meet ever increasing performance requirements, e.g. increased stress capability, need for longer durability, and cost effective manufacture. In certain types of engines, such as diesel engines used in over-the-road commercial trucks, manufacturers have increased injection pressures to improve the performance, efficiency and lowered emissions to meet governmentally mandated standards. However, these high injection pressures have significantly increased stress requirements and torsional loads on such engine cam shafts. Increasing the camshaft's diameter is one way to meet such increased demand. One problem associated with using a large diameter camshaft, however, is the amount of weight it adds to the engine. Hence, at least some of the benefits associated with a camshaft of unusually large diameter could be lost unless its weight is minimized.

Another problem faced by engineers in the engine industry is designing an engine that provides an adequate amount of lubricant to the camshaft and camshaft bearing journals in order to cool these parts, reduce undesired friction and minimize wear during engine operation. If any of these factors are not met, the engine could suffer substantial damage and possibly engine failure.

Certain engine manufacturers have attempted to develop hollow camshafts to reduce the weight of the engine while trying to provide adequate lubrication to the camshaft journal bearings. For example, U.S. Pat. No. 4,957,079 to Nakatani et al. discloses an exhaust overhead camshaft formed with an axial oil passage extending along substantially its entire length and communicating with radial oil passages formed in the camshaft bearing journals. An oil passage extends upward from midway of a laterally extending oil passage and opens to an annular groove of a plain split thrust bearing for the exhaust overhead camshaft. The engine lubrication oil flows through the oil passage and into the annular groove of the plain split thrust bearing for the exhaust overhead camshaft, to oil the thrust collars. The lubricating oil passing up to the thrust collars further flows, through the radial oil passages formed in the thrust collars, into the axial oil passage in the camshaft. The radial oil passages formed in the camshaft bearing journals of the camshaft allow the lubricating oil to flow in the axial oil passage to lubricate the bearings of the camshaft.

The '079 Nakatani patent discloses only one inlet for lubricant to flow into the axial oil passage of the camshaft which limits the volume and distribution of lubricant to the camshaft bearing journals during engine operation. In addition, if the one inlet of Nakatani becomes clogged, no lubricant would be available for the camshaft bearing journals potentially causing severe engine problems. In addition, the structural design of the Nakatani camshaft does not allow for even distribution of lubricant from the engine head to the camshaft journal bearings since lubricant is introduced only at one end of the camshaft. As stated above, it is imperative that lubricant is allowed to enter into the camshaft unimpeded to prevent any clogging or other undesirable event which could impair fluid communication between engine parts and impair adequate lubrication of critical engine parts.

By creating a hollow camshaft structure including a hollow shell with radial holes formed therein, an engineer must consider torsional and other load influences on the camshaft body during engine operation. A hollow camshaft used in a large, heavy duty engine environment must be able to withstand high injection pressures and other stress-related forces which can over stress or even break the camshaft. Therefore, the hollow camshaft must be formed in a way that reduces the impact of torsional loads exerted on the camshaft during engine operation while providing adequate lubrication to the camshaft journal bearings. The '079 patent does not suggest the desirability of maximizing the volume and selecting the shape of the hollow interior to reduce thereby the weight of the camshaft while also producing adequate strength and other operating characteristics as discussed above.

One reference which focuses on this problem is U.S. Pat. No. 4,072,448 to Loyd, Jr. which discloses holes formed in a camshaft body to allow lubricant to flow therethrough. Each of the holes are formed spaced apart in different planes in the camshaft body. The formation of the holes in this manner improves the load characteristics of a hollow camshaft. However, the structural design of the Loyd camshaft does not insure adequate fluid communication and distribution to the camshaft journal bearings and other critical areas of the camshaft.

It is evident, based on the references discussed above, no hollow camshaft has been developed which provides effective fluid communication between the engine cylinder head, camshaft and camshaft journal bearings while operating under high injector pressures and torsional loads.

SUMMARY OF THE INVENTION

In view of the foregoing, it is an object of the present invention to provide an improved high strength, lightweight camshaft which facilitates effective lubricant flow between an engine cylinder head, camshaft and camshaft journal bearings while facilitating high performance engine operation.

It is also an object of the present invention to achieve the above object and to provide an improved high strength, lightweight camshaft that reduces expensive-to-manufacture lubricant drillings within the cylinder head that would normally be required to accomplish lubricating the camshaft journal bearings.

It is another object of the present invention to achieve one or more of the above objects, and to provide an improved high strength, lightweight camshaft for use in an internal combustion engine wherein a supply a lubricant always remains in the camshaft to aid in lubricating bearings during engine start-up conditions.

It is further an object of the present invention to achieve one or more of the above objects, and to provide an improved high strength, lightweight camshaft having a hollow interior formed in the camshaft body for receiving lubricant from an engine cylinder head and effectively transferring the lubricant to at least one camshaft journal bearing during engine operation.

It is also an object of the present invention to achieve one or more of the above objects, and to further provide an improved high strength, lightweight camshaft having at least a pair of camshaft journal bearings positioned adjacent the ends of the camshaft body which include a lubricant transfer means for providing at least two paths for lubricant to flow into the hollow interior of the camshaft to insure even distribution of lubricant to the camshaft journal bearings.

It is still another object of this invention to provide a camshaft having a drive gear mounting at one end and plural journal bearings located at spaced apart positions along the axial length of the camshaft wherein the camshaft has a hollow interior extending along substantially its full axial length, but the effective diameter of the hollow interior is substantially less from the drive gear mounting end to the second bearing journal closest to the drive gear mounting end as compared with the effective diameter of the hollow interior along the remainder of the camshaft to minimize total weight of the camshaft while providing adequate distortion resistant strength at the drive gear mounting end of the camshaft.

It is a yet another object of the present invention to achieve one or more of the above objects and also provide an improved high strength, lightweight camshaft having radial holes formed in different axial planes of the camshaft body to minimize the impact of torsional and other stress-related loads on the camshaft body during engine operation.

It is a further object of the present invention to achieve one or more of the above objects and also provide an improved high strength, lightweight camshaft having a hollow interior diameter between 24 percent and 59 percent of the camshaft body diameter.

These, as well as other objects of the present invention, are achieved by a high strength, lightweight camshaft for an internal combustion engine, comprising a shaft body having an axially oriented hollow interior extending a predetermined length from between a pair of spaced points, respectively, adjacent the ends of the shaft body. Plural camshaft journal bearings are spaced apart on the shaft body and include a pair of end camshaft journal bearings positioned adjacent the ends of the shaft body, respectively, with at least one inner camshaft journal bearing positioned intermediate the pair of end camshaft journal bearings. Each end camshaft journal bearing has a lubricant transfer means formed therein for receiving lubricant from an external supply and for transferring lubricant into the hollow interior of the camshaft. At least one radial hole is formed in the shaft body for providing lubricant from the hollow interior to an inner camshaft journal bearing wherein the lubricant transfer means associated with the pair of end camshaft journals provides at least two paths for lubricant to flow into the hollow interior of the camshaft for providing an even distribution of lubrication to each inner camshaft journal bearing during operation of the internal combustion engine.

The camshaft body includes an axial passage extending from an end of the shaft body to the hollow interior to allow fluid communication between the axial passage and hollow interior. A cap and a plug are secured to the respective ends of the shaft body for preventing lubricant leakage from the axial passage and hollow interior, respectively. A supply of lubricant always remains in the camshaft to assist in lubricating the camshaft journal bearings during engine start-up.

The lubricant transfer means includes a groove which radially extends along the outer surface of each end camshaft journal bearing and a flow passage for allowing fluid to communicate between an external supply and the hollow interior via the groove. Radial holes are equal angularly arranged about the circumference of the camshaft body. These radial holes intersect the hollow interior of the camshaft to allow fluid communication.

In addition, the camshaft is arranged to be rotatably mounted on an engine head and supported thereon by a plurality of bearing collars located in spaced apart positions along the axial length of the camshaft. The camshaft also has a camshaft journal bushing positioned in an abutting relationship between at least one of the camshaft journal bearings and at least one of the plurality of collars. The camshaft journal bushing has a radial opening formed therein to allow lubricant to flow therethrough.

DETAILED DESCRIPTION OF PREFERRED EMBODIMENTS

The present invention is directed to a high-strength, light-weight camshaft for use in an internal combustion engine, particularly for use in compression-ignition engines equipped with high pressure, cam operated, unit fuel injectors. The camshaft is designed to withstand high bending and torsional loads while producing high injection pressures and increased engine power to improve the performance of vehicles, such as over-the-road commercial trucks, in which the camshaft is used. By increasing the pressure of fuel, such as liquid diesel fuel, as it is injected into a combustion chamber, the fuel is mixed more thoroughly with the charge air within the combustion chamber. Ideally, the fuel and charge air are homogeneously mixed prior to ignition. Injection pressures of about 18,000 psi, and as high as 25,000 psi, help promote better mixing of the fuel and charge air. Better mixture of fuel and charge air not only helps to reduce undesired emissions, such as smoke and unburned hydrocarbons, but also significantly improves engine power and efficiency. High fuel injection pressures can be obtained by the use of cam operated unit fuel injectors such as disclosed in a variety of patents issued to Cummins Engine Co., Inc., assignee of the subject invention. For example, note U.S. Pat. Nos. 4,721,247; 4,986,472; and 5,094,397.

Figure 6:
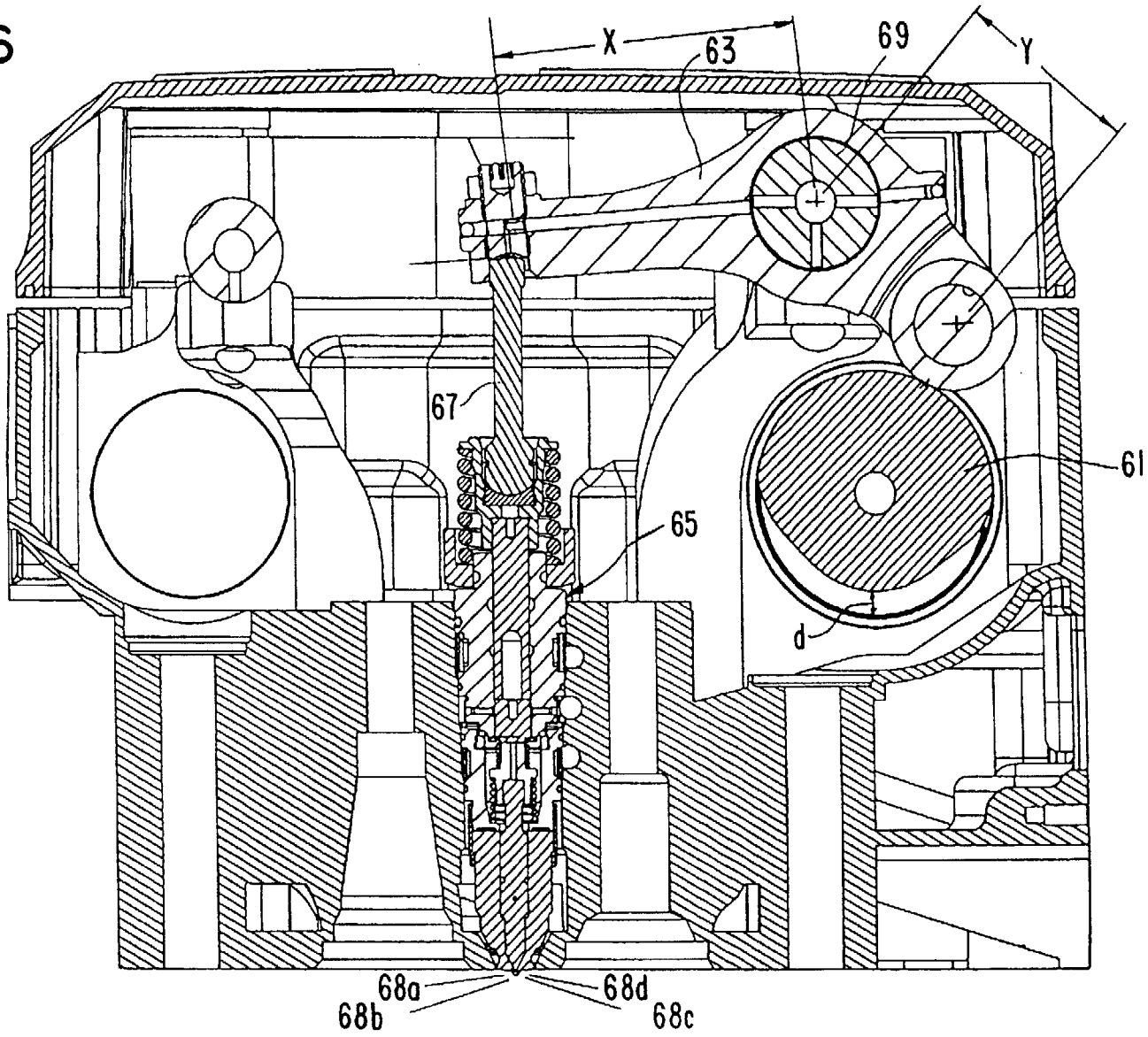
FIG. 6 is a partial cross-sectional view of a diesel engine illustrating the camshaft of FIGS. 1 and 2 mounted within the engine head of FIG. 2 and arranged to cyclically operate an engine unit injector through a rocker arm and link.

One of the factors imposing limitations on increased fuel injection pressure is the inability of cam surfaces to withstand surface pressure above a certain limit without failure or excessive wear. Another limitation is the ability of a camshaft to avoid excessive bending stress and excessive bearing wear. One technique for overcoming, to some degree, these limitations is to increase the diameter of the cam to increase the cam surface area and the strength of the camshaft. A camshaft of increased size and rigidity permits the camshaft to withstand the significantly greater bending and torsional loads imposed when the injection pressure is increased. In FIG. 6, for example, a cam 61 attached to a camshaft may be used to actuate a rocker arm 63 which, in turn, actuates the plunger of a high pressure fuel injector 65 via link 67 used in a diesel engine. Rocker arm 63 is pivotally mounted on a support rod 69 which is positioned in a rod mounting 66 (shown partially in FIG. 3) attached to an engine cylinder head. One revolution of the camshaft moves rocker arm 63 an approximate distance d, shown in FIG. 6, between a first and second position, to actuate the plunger of high pressure fuel injector 65 and inject fuel under high pressure into an engine cylinder (not shown) through an injector nozzle to form fuel spray patterns 68*a*–68*d*. A cam increased in diameter allows the fulcrum of the rocker arm to be moved closer to the injector, thus, increasing the distance "y" and decreasing the distance "x" illustrated in FIG. 6, to provide an increased mechanical advantage (thereby allowing greater injection pressure) without increasing pressure on the cam surfaces. Thus, in accordance with one aspect of the subject invention, a camshaft having a relatively large diameter is able to generate the desired injection pressures while withstanding the bending and torsional loads acting thereon.

By simply increasing the diameter of the camshaft to obtain the benefit of high injection pressure, however, the weight of the engine would be undesirably increased. The present invention provides a camshaft of sufficient size and rigidity to withstand high injection pressures without significantly adding weight to the internal combustion engine. In addition, the camshaft of the present invention facilitates even distribution of lubricant to vital engine parts during all stages of engine operation, including start-up, in order to reduce wear and also to reduce manufacturing costs normally associated with conventional camshaft designs. The present invention, as used in the environment described above, is explained in detail below with reference to FIGS. 1–5.

Figure 1B:
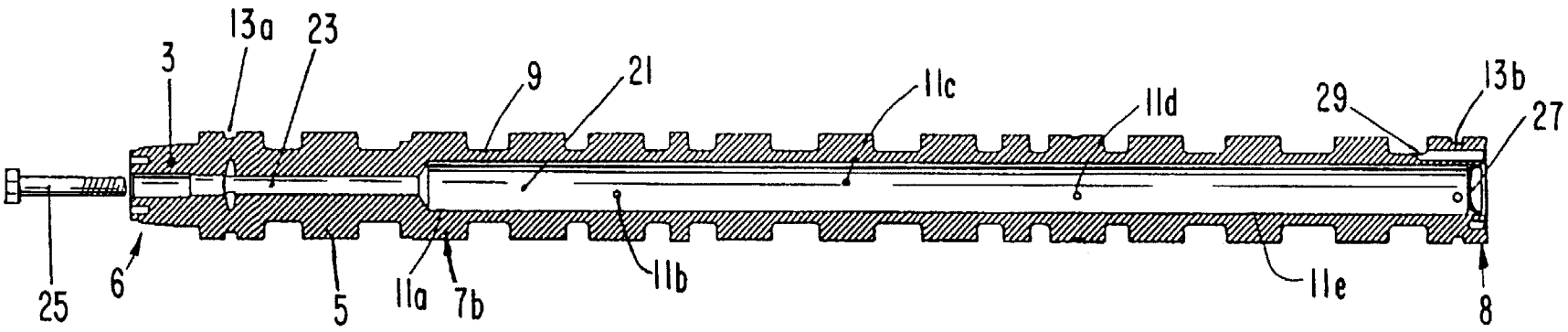
FIG. 1*b* is a cross-sectional view of the camshaft of FIG. 1*a* in accordance with a preferred embodiment of the present invention.
Figure 1A:
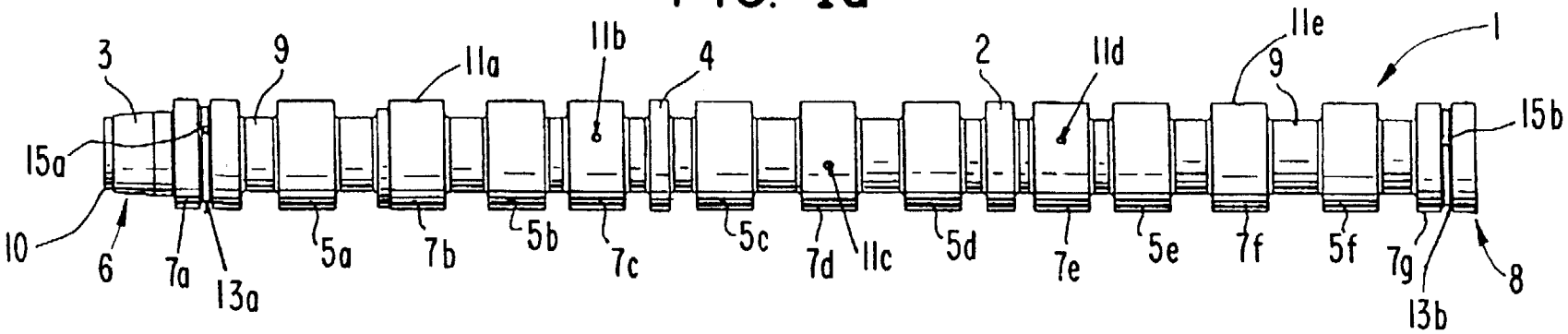
FIG. 1*a* is an elevational view of a camshaft in accordance with a preferred embodiment of the present invention.

FIGS. 1*a* and 1*b* provide an elevational and cross-sectional view, respectively, of a camshaft designed in accordance with the preferred embodiment of the present invention. Specifically, FIG. 1*a* illustrates a camshaft 1 which is dedicated exclusively to operate a plurality of unit injectors in timed synchronization with the reciprocal movement of corresponding pistons within the cylinders of a compression ignition engine. Camshaft 1 comprises a camshaft body 3 having a tubular shape. Camshaft body 3 includes a series of injector cams or lobes 5*a*–5*f* and camshaft journal bearings 7*a*–7*g* spaced equidistant apart in an alternating pattern beginning from a first end 6 to a second end 8. A plurality of grooves 9 separate the injector lobes and camshaft journal bearings. The minimum cross-sectional diameter of camshaft body 3 occurs within the trough of each groove 9. The minimum diameter is significant in determining the maximum bending and torsional stress limits of camshaft 1 as discussed in greater detail below. Each of the camshaft journal bearings 7*b*–7*f* includes radial holes 11*a*–11*e* formed therein. Radial holes 11*a*–11*e* extend perpendicularly with respect to the camshaft axis and provide a passage that delivers lubricant to each of camshaft journal bearings 7*b*–7*f* during engine operation.

Camshaft journal bearings 7*a* and 7*g* are positioned adjacent to first end 6 and second end 8, respectively. Moreover, camshaft journal bearings 7*a* and 7*g* include lubricant transfer grooves 13*a* and 13*b* which radially extend along the central perimeter of each camshaft journal bearing. Flow passages 15*a* and 15*b* (FIG. 1*a*) are formed within camshaft body 3 to provide fluid communication from lubricant transfer grooves 13*a* and 13*b*, respectively, into the hollow interior of camshaft body 3. In an alternative embodiment, lubricant transfer grooves may be formed in camshaft journal bearings 7*b*–7*f* to facilitate lubricant distribution. Flow passages would be formed in the camshaft body for each additional lubricant transfer groove to allow lubricant to flow between the hollow interior of the camshaft body and each camshaft journal bearing.

First end 6 of camshaft body 3 includes a tapered portion 10 formed thereon to allow a camshaft drive gear (not shown) to be mounted onto camshaft body 3 for rotatably driving the camshaft. The drive gear forms part of a gear train (not illustrated) mounted on the end of the engine and is driven by a drive gear mounted for rotation with the crankshaft of the engine. Camshaft body 3 further includes a timing lobe 2 and a fuel system gear lobe 4 positioned between camshaft journal bearing 7*e* and injector lobe 5*d*, and camshaft journal bearing 7*c* and injector lobe 5*c*, respectively. Timing lobe 2 is used to track the rotational position of the camshaft at a particular time. Fuel system gear lobe 4 is formed on camshaft body 3 to drive a fuel pump (not shown) in an internal combustion engine.

FIG. 1*b* is a cross-sectional view of camshaft 1 illustrated in FIG. 1*a*. As shown in FIG. 1*b*, camshaft body 3 includes an axially oriented hollow interior 21 which extends from camshaft journal bearing 7*b* to second end 8. Hollow interior 21 may be formed by an axial drilling or other manufacturing process. An axial passage 23 is also formed in camshaft body 3 and extends from first end 6 to camshaft journal bearing 7*b*, where axial passage 23 intersects hollow interior 21. Camshaft body 3 is hollowed from first end 6 to second end 8, as illustrated in FIG. 1*b*, to allow lubricant to freely flow therethrough.

The inner cavity of camshaft body 3, namely hollow interior 21 and axial passage 23, is sealed at both ends to prevent lubricant from escaping therefrom. At first end 6, a capscrew 25 is provided to mount the camshaft drive gear (not shown) as well as to effectively seal off axial passage 23 extending through camshaft body 3. Likewise, an expansion plug 27 is provided at second end 8 to seal off hollow interior 21. Alternatively, a pressure plug or other type of sealing device may be used to seal off hollow interior 21, however, expansion plug 27 is preferred. With the use of capscrew 25 and expansion plug 27, the inner cavity of camshaft body 3 is effectively end sealed to ensure that a supply of lubricant always remains in camshaft 1 to aid in lubricating camshaft journal bearings 7*b*–7*f* through radial holes 11*a*–11*e* during engine start-up conditions. Normally, when an engine is cranked, engine parts immediately contact one another before lubricant is fully supplied, resulting in undesired bearing surface engine wear. By supplying lubricant immediately to the camshaft journal bearings during engine start-up, engine wear can be significantly reduced over the life of the engine, thus, reducing maintenance cost and undesired downtime. An oil return passage 29 is also formed in camshaft body 3 to drain any oil which leaks from camshaft journal bearing 7g and becomes trapped between second end 8 and an end cap (not shown) during engine operation. Oil return passage 29 prevents build-up of fluid pressure between second end 8 and the end cap (not shown) due to the oil leakage.

Hollow interior 21 and axial passage 23 allow camshaft 1 to have an increased outer cross-sectional diameter without adding excessive weight to the engine. Therefore, the benefits of camshaft body 3 as explained herein can be realized without any undesired effects. In particular, the exterior diameter of each injection cam or lobe 5a–5f can be increased in diameter to allow substantially increased injection pressure without exceeding the limit of cam surface pressures and without exceeding the torsional and bending stress limits of the camshaft. At the same time, engine weight is held within acceptable limits by providing the maximum possible hollow interior volume. In particular, camshaft body 3 is designed to withstand the high bending and torsional loads that necessarily result from increasing the pressure at which fuel is injected. To accomplish this without excessive weight increase, hollow interior 21 is formed with the maximum possible diameter from camshaft journal bearing 7b to the second end 8 of the camshaft body 3. The portion of camshaft body 3 extending from first end 6 to camshaft journal bearing 7b includes axial passage 23, which has a significantly smaller diameter than hollow interior 21, thus, resulting in a thicker camshaft portion at the first end of camshaft body 3. This feature of the present invention is critical, since first end 6 experiences higher torsional and bending loads than second end 8 due to the force exerted by the cam drive gear (not shown) which attaches to camshaft body 3 at first end 6. By having a smaller axial passage in the portion of camshaft body 3 connected to a cam gear (not shown), the camshaft has increased rigidity at its first end between the first and second camshaft bearings 7a and 7b to ensure that undesired bending stresses and torsional loads do not adversely impact camshaft body 3 when generating high injection pressures. Furthermore, radial holes 11a–11c are arranged angularly about the circumference of camshaft body 3 to minimize the impact of stress and torsional loads on the camshaft. Thus, the present invention achieves a high-strength, lightweight camshaft that is designed to counteract any adverse bending or torsional stresses while having the necessary size to create high injection pressures for optimal engine performance.

In a preferred embodiment, the diameter of camshaft journal bearings 7a–7g, illustrated in FIG. 1a, is approximately 85 millimeters; however, depending on the desired injection characteristics, the diameter of camshaft journal bearings 7a–7g could range between 70 millimeters and 100 millimeters. The inner surface of groove 9, in the preferred embodiment, is 58 millimeters. As with the diameter of the camshaft journal bearings, this diameter may vary depending on the desired injection response. The preferred diameter of the hollow interior is 40 millimeters with a length of approximately 850 millimeters. However, the inner diameter may range between 20 millimeters and 50 millimeters, depending on a particular camshaft application. For most practical applications, the inner diameter of the hollow interior may be between 24% and 59% of the diameter of the camshaft journal bearings, however, in the preferred embodiment, the percentage is approximately 47%.

Camshaft 1 preferably has a length of approximately 1,104 millimeters and weighs approximately 64 pounds. This camshaft is designed to be used with a 6-cylinder engine and may be modified to accommodate an engine having a smaller or a larger number of cylinders, as desired. The camshaft of the preferred embodiment is formed from steel, however, it may be formed from other suitable materials, such as cast iron, depending on the desired characteristics and applications.

Certain factors to consider in forming camshaft 1 to meet a specific application are discussed in detail below. These factors may include stress, moment, and moment of inertia which are used to calculate the camshaft's ability to withstand bending loads. A mathematical representation of these factors using the inside diameter of hollow interior 21 and the inner surface diameter of groove 9 is provided. Depending on the combination of diameters, and based purely on bending stress, the equations below could be used to cover a range of practical applications based on the camshaft size and desired rigidity.

When considering only pure bending, the following parameters are used:

$\sigma$ - Stress

M - Moment (Force×Distance)

I - Moment of Inertia $d_1$ - Inner surface diameter of groove 9

$d_2$ - Inside diameter of hollow interior 21

C - Radius of groove 9 ($C=d_1/2$)

Bending stress is determined by:

$\sigma_B=MC/I$ wherein $I=\pi/64\ (d_1^4-d_2^4)$

Substituting I into the equation for bending stress:

$\sigma\alpha\ MC/(d_1^4-d_2^4)$

Practical diameter values of the inner surface diameter of groove 9 ($d_1$), the inside diameter of hollow interior 21 ($d_2$) and radius (C) are provided below:

$d_1$=58 mm $d_2$=40 mm $d_2$=20 mm

C=29 mm

Using the formula for stress and the variables defined above, a mathematical representation of bending stress with respect to a camshaft size (inner and outer diameters) is provided below:

To determine bending stress using $d_2$=40 mm:

$\sigma\alpha\ M(29)/((58)^4-(40)^4)\ (64/\pi)$ $\sigma d_1\ \alpha\ 67.47\times10^{-6}\ (M)\ 1/mm^3$ Substituting $67.47\times10^{-6}$ (M) $1/mM^3$ in for $\sigma d_1$, the following equation for bending stress results (note that M cancels out):

$67.47\times10^{-6}=C/I$ $67.47\times10^{-6}=C/\pi/64\ (d_1^4-d_2^4)$ where $C=d_1/2$ To determine bending stress using $d_2$=20 mm:

$\sigma\alpha\ M(29)/((58)^4-(20)^4)\ (64/\pi)$ $\sigma d_2\alpha\ 52.95\times10^{-6}\ (M)\ 1/mm^3$ Substituting $52.95\times10^{-6}$ (M) $1/mm^3$ in for $\sigma d_1$, the following equation for bending stress results (note that M cancels out):

$52.95\times10^{-6}=C/I$ $52.95\times10^{-6}=C/\pi/64\ (d_1^4-d_2^4)$ where $C=d_2/2$ The mathematical analysis presented above may be used to calculate the amount of bending stress a camshaft is able to withstand based on the inner surface diameter of the camshaft body (outer diameter) and the inner diameter of the camshaft's hollow interior. For example, using the diameters provided above, the bending stress $\sigma$ of a camshaft having an inner surface diameter of 58 mm, a hollow interior diameter of 40 mm and a radius of 29 mm is approximately $67.47\times10^{-6}$ (M) 1/mm$^3$, depending on the moment M. Thus the above equations could be used to determine the type of material from which the camshaft needs to be made or to allow the diameters $d_1$ and $d_2$ to be adjusted to insure that the camshaft will have adequate strength.

Figure 2:
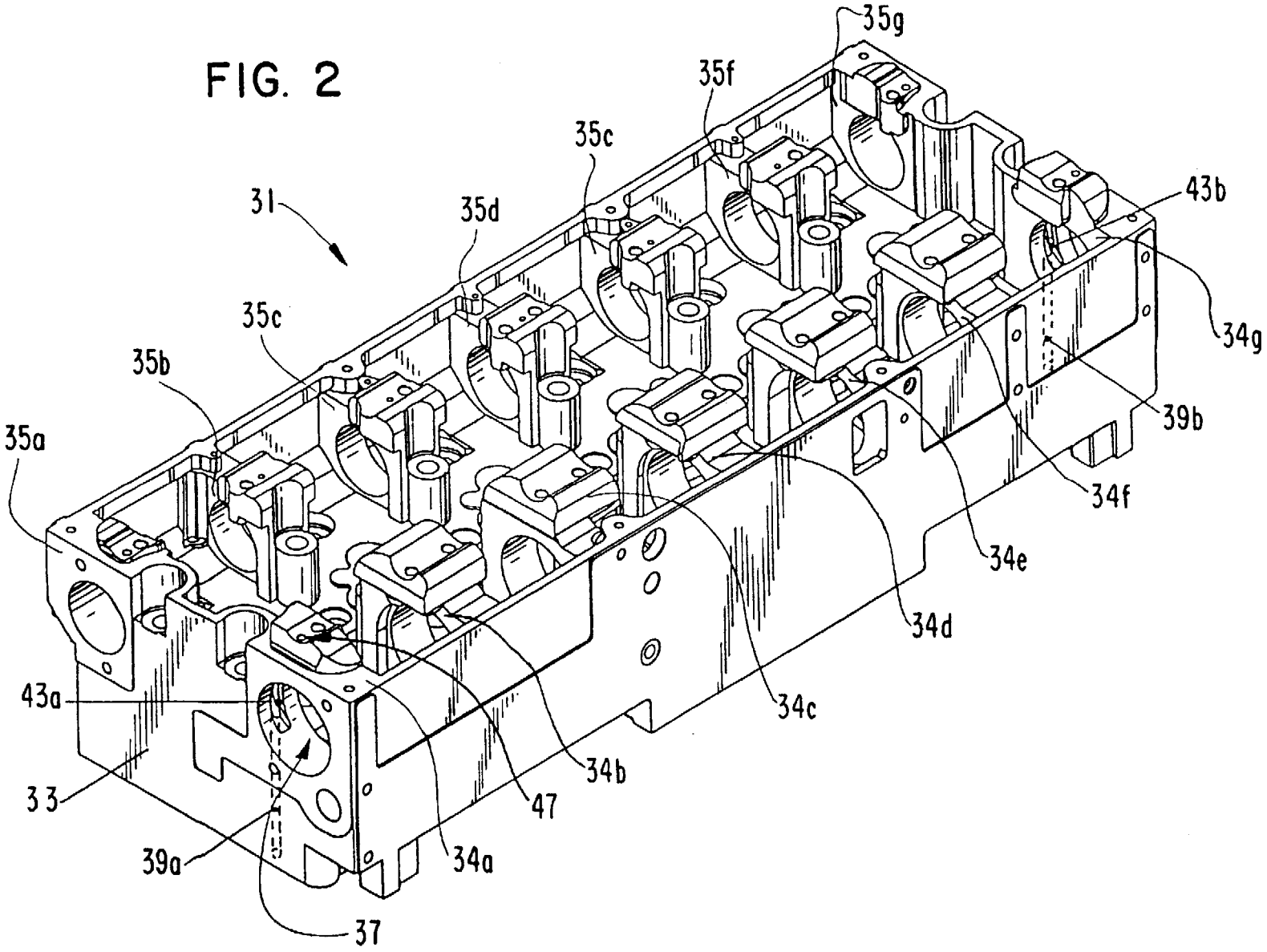
FIG. 2 is a perspective view of a cylinder head for an internal combustion engine in accordance with a preferred embodiment of the present invention.

FIG. 2 is a perspective view of a cylinder head 31 for an internal combustion engine in accordance with the preferred embodiment of the present invention. Cylinder head 31 includes a cylinder head body 33 having two sets of collars 34*a*–34*g* and 35*a*–35*g* located in positions along the lateral sides of the head. These collars are spaced apart and rigidly attached to the head to form an axial mounting for two separate camshafts. Collars 35*a*–35*g* are formed to receive a more conventional type of camshaft for actuating the exhaust or intake valves associated with each engine cylinder. In contrast thereto, collars 34*a*–34*g* are arranged to receive a camshaft of substantially greater diameter, such as camshaft 1, formed in accordance with the subject invention, dedicated solely to driving the engine's fuel injectors through rocker arms, as illustrated in FIG. 6. Although cylinder head body 33 is designed to receive dual camshafts, only the mounting of camshaft 1 will be discussed herein. In addition, cylinder head body 33 merely illustrates one environment in which camshaft 1 may be used. One skilled in the art should recognize that camshaft 1 may be used in a variety of engine applications including a dual overhead cam design or a single cam design.

Figure 3:
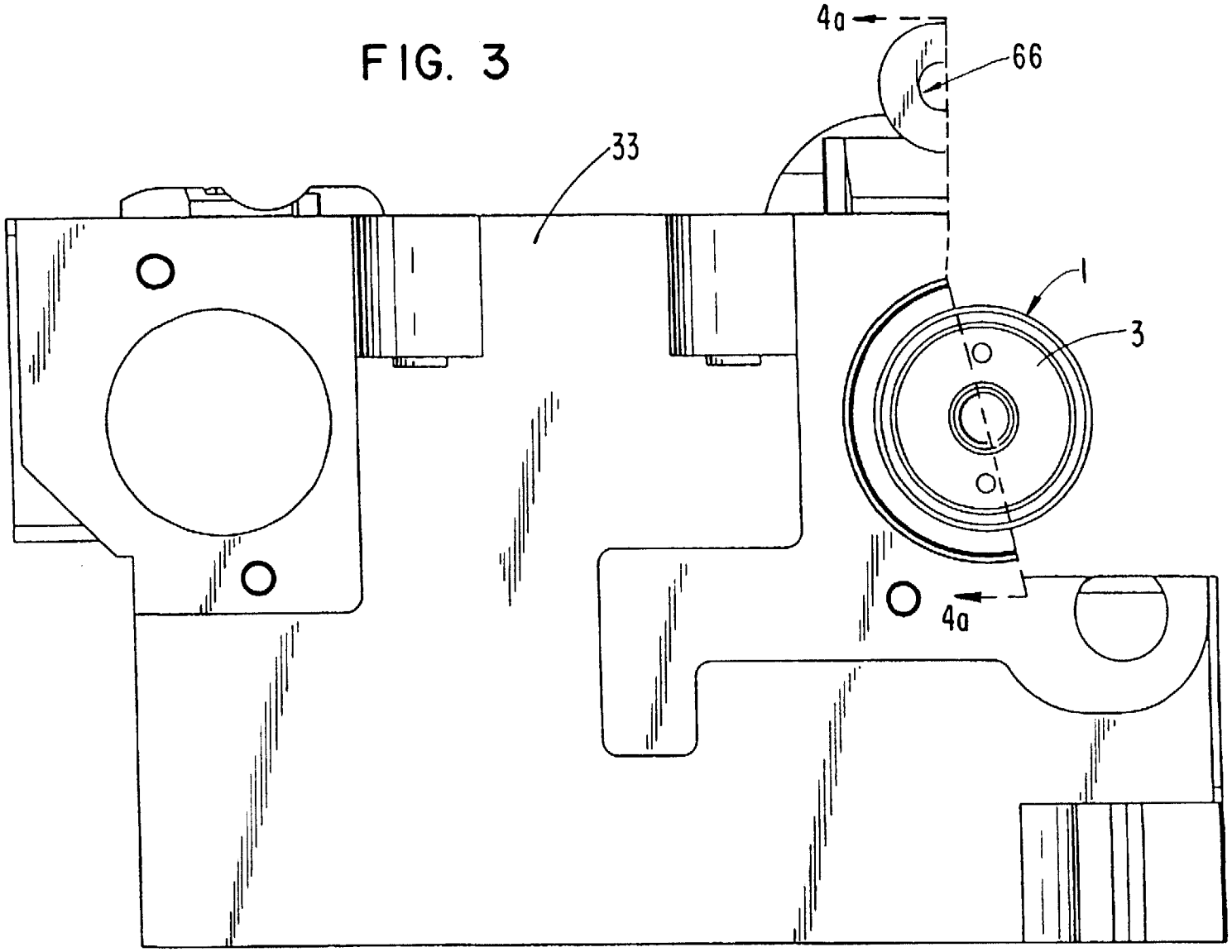
FIG. 3 is side elevational view of the cylinder head of FIG. 2 and the camshaft of FIG. 1 in accordance with a preferred embodiment of the present invention.
Figure 4:
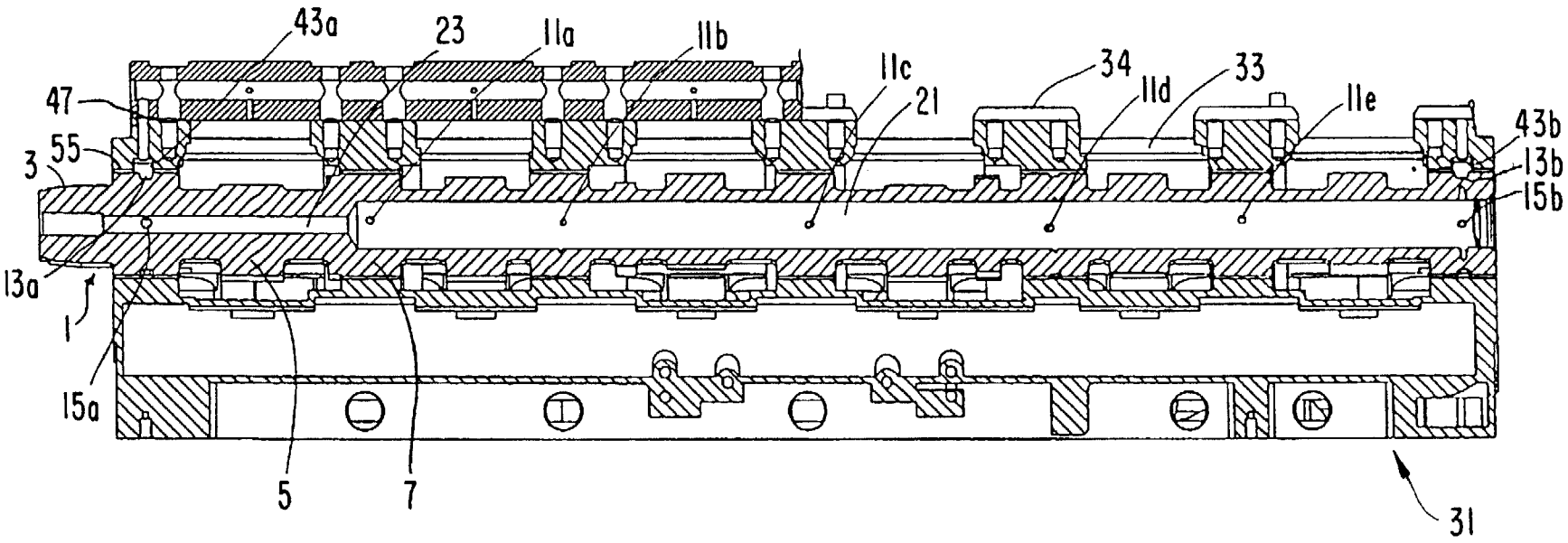
FIG. 4 is a cross-sectional view of a camshaft positioned in a cylinder head in accordance with a preferred embodiment of the present invention.

Camshaft 1 is rotatably mounted in cylinder head body 33 by inserting second end 8 of camshaft 1 through opening 37 formed in cylinder head body 33, and subsequently advancing camshaft 1 through collars 34*a*–34*g* until each of camshaft journal bearings 7*a*–7*g* is located within the respective collars 34*a*–34*g* as shown in FIGS. 3 and 4. Camshaft 1 is able to freely rotate within cylinder head body 33 when mounted and secured thereto by end plates (not shown). In addition to collars 34*a*–34*g*, cylinder head body 33 further includes lubricant passages 39*a* and 39*b* which are formed in the sidewalls of cylinder head body 33.

During engine start-up conditions, lubricating oil is pumped from an oil pan (not shown) located underneath the cylinder head and forced upward to lubricate vital engine parts during engine operation. The pump forces oil into lubricating passages 39*a* and 39*b* which deliver oil to a plurality of rocker arms (FIG. 6) through supply passage 47 of FIG. 2, camshaft 1 and ultimately camshaft journal bearings 7*a*–7*g*. Lubricating passages 39*a* and 39*b* terminate at lubricating grooves 43*a* and 43*b*, illustrated in FIG. 2, at which lubricant is transferred to camshaft 1. One advantage of the present invention is that lubricant is supplied to both ends of camshaft 1 simultaneously to provide an even distribution of lubricating oil to all the camshaft bearing journals during engine operation. This is critical in maintaining proper lubrication to reduce engine wear resulting from extreme temperatures and friction. The transfer of lubricating oil from cylinder body 33 to camshaft 1 will be described in greater detail with reference to FIGS. 4 and 5.

Figure 5:
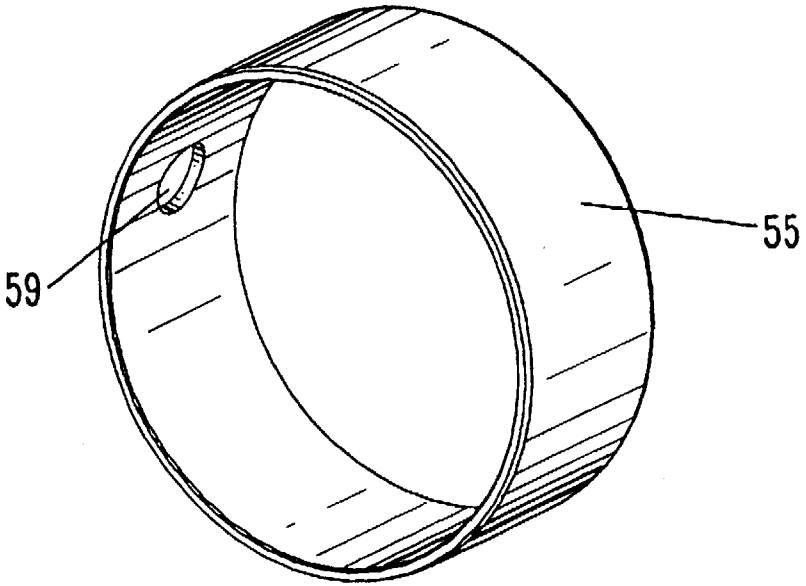
FIG. 5 is perspective view of a camshaft journal bushing identified in FIG. 4 in accordance with a preferred embodiment of the present invention.

FIG. 4 is a cross-sectional view of camshaft 1 positioned in cylinder head 31 in accordance with a preferred embodiment of the present invention. This cross-sectional view is taken along line 4*a*—4*a* in FIG. 3. FIG. 4 specifically shows the manner by which camshaft 1 is rotatably mounted within cylinder head 31 and illustrates the manner by which lubricant is transferred into and out of the interior of camshaft 1 to insure adequate lubrication of the camshaft bearings at all stages of engine operation. Lubricant is transferred from engine cylinder head 31 to camshaft 1 via lubricating grooves 43*a* and 43*b*, which are respectively aligned with lubricant transfer grooves 13*a* and 13*b* with a camshaft journal bushing 55 (see FIG. 5) positioned therebetween. As shown in FIG. 5, the camshaft journal bushing 55 is a ring-shaped bushing having an aperture 59 formed therein. Lubricant flows through aperture 59 as it is transferred between lubricating passages 39*a* and 39*b* and lubricant transfer grooves 13*a* and 13*b* formed in camshaft journal bearings 7*a* and 7*g*, respectively. After lubricant travels into lubricant transfer grooves 13*a* and 13*b*, it flows through radial flow passages 15*a* and 15*b* and into axial passage 23 and hollow interior 21, respectively. Since an even flow of lubricant is introduced into each end of the camshaft, the inner cavity of camshaft 1 rapidly becomes fully pressurized with lubricant which is critical during engine start-up conditions. This pressurization forces lubricant into each of radial holes 11*a*–11*e* to lubricate camshaft journals 7*b* through 7*f*. Even before the lubricant is fully pressurized, the hollow interior 21 and axial passage 23 will have trapped lubricant upon previous termination of engine operation. This reservoir of lubricant will help insure that at least some lubricant reaches critical bearing surfaces before the engine's lubrication pump is able to provide sufficient lubricant to fully pressurize interior 21 and axial passage 23. Faster and more even pressurization occurs because lubricant is simultaneously supplied at opposite ends of the camshaft. Moreover, the redundancy also helps to insure adequate lubricant flow even if one of the supply passages were to become clogged.

The present invention introduces a novel approach of providing lubricant to camshaft journal bearings without requiring complex manufacturing techniques. In addition, the present invention provides a camshaft design that is simple to manufacture, reduces the weight of an engine, facilitates adequate lubrication to vital engine parts, and is able to facilitate high injection pressures resulting in increased engine power and performance.

Industrial Application

The present invention is particularly useful in compression ignition engines for use in any application where weight is a significant factor.

What is claimed is:

1. A high strength, lightweight camshaft for an internal combustion engine, comprising:

a camshaft body having an axially oriented hollow interior extending a predetermined length between a pair of spaced points, respectively, adjacent the ends of said camshaft body;

plural camshaft journal bearings spaced apart on said camshaft body, said camshaft journal bearings including a pair of end camshaft journal bearings positioned adjacent the ends of said camshaft body, respectively, and at least one inner camshaft journal bearing positioned intermediate said pair of end camshaft journal bearings, said each end camshaft journal bearing having a lubricant transfer means formed therein for receiving lubricant from an external supply and for transferring lubricant into said hollow interior; and at least one radial hole formed in said camshaft body for each said inner camshaft journal bearing for providing lubricant from said hollow interior to said inner camshaft journal bearing;

wherein said lubricant transfer means associated with said pair of end camshaft journals provides at least two paths for lubricant to flow into said hollow interior of said camshaft for providing an even distribution of lubrication to each said inner camshaft journal bearing during operation of the internal combustion engine.

2. The camshaft of claim 1 further comprising an axial passage extending through a first end of said camshaft body to said hollow interior to allow fluid communication therebetween, wherein said axial passage has an effective diameter substantially less than said hollow interior diameter to minimize the total weight of said camshaft body while providing adequate distortion resistant strength at said first end.

3. The camshaft of claim 2 wherein said first end of s aid camshaft body includes a camshaft drive gear mounting.

4. The camshaft of claim 1, wherein said camshaft body includes at least a first and second camshaft journal bearing spaced apart on said camshaft body, said first camshaft journal bearing adjacent a first end of said camshaft body and said second cam shaft journal bearing positioned adjacent said first camshaft journal bearing, said hollow interior extending from said second camshaft journal bearing to a second end of said camshaft body.

5. The camshaft of claim 1, wherein said lubricant transfer means includes a groove which radially extends within each end camshaft journal bearing and a flow passage for allowing fluid to communicate between said external supply and said hollow interior.

6. The camshaft of claim 1, wherein said radial holes are angularly arranged about the circumference of said camshaft body.

7. The camshaft of claim 1, further comprising a capscrew which secures to an end of said camshaft body for preventing the leakage of lubricant therefrom.

8. The camshaft of claim 7, further comprising a plug which is mounted on an end opposite said capscrew for preventing the leakage of lubricant therefrom.

9. The camshaft of claim 1, wherein said radial holes are perpendicular to said camshaft body and intersect said hollow interior.

10. The camshaft of claim 5, wherein said flow passage is perpendicular to said camshaft body and intersect said axial passage.

11. The camshaft of claim 5, wherein said flow passage intersects said hollow interior.

12. The camshaft of claim 1, wherein the diameter of said camshaft body is in the range of 70 mm to 100 mm.

13. The camshaft of claim 1, wherein the diameter of said hollow interior is in the range of 10 mm to 40 mm.

14. The camshaft of claim 1, wherein the length of said camshaft body is greater than 1100 mm.

15. The camshaft of claim 1, wherein said hollow interior has a length of 850 mm.

16. The camshaft of claim 5, wherein said groove has a cross-sectional diameter of 58 mm.

17. The camshaft of claim 1, further comprising a cylinder head body having a plurality of collars spaced apart and rigidly attached thereto to form an axial mounting for receiving said camshaft body such that said collars are respectively aligned with each of said camshaft journal bearings when said camshaft body is mounted in said cylinder head body.

18. The camshaft of claim 17, further comprising a camshaft journal bushing positioned in an abutting relationship between at least one of said camshaft journal bearings and at least one of said plurality of collars, said camshaft journal bushing having a radial opening formed therein to allow lubricant to flow therethrough.

19. The camshaft of claim 1, wherein said camshaft body is tapered at one end.

20. The camshaft of claim 1, wherein said hollow interior of said camshaft body retains lubricant when the internal combustion engine is not operating in order to provide immediate lubrication to said camshaft journal bearings during start-up of the internal combustion engine.

21. The camshaft of claim 1, wherein the diameter of said hollow interior is between 24 percent and 59 percent of the diameter of said camshaft body.

22. The camshaft of claim 21, wherein said camshaft body includes an axial passage extending from an end of said camshaft body to said hollow interior to allow fluid communication between said axial passage and said hollow interior.

23. The camshaft of claim 21, wherein said camshaft body further includes plural inner camshaft journal bearings and corresponding radial holes formed in the wall of said camshaft body to allow fluid communication with an opening in each of said inner camshaft journal bearings.

24. The camshaft of claim 23, wherein said radial holes are angularly arranged about the circumference of said camshaft body.

25. The camshaft of claim 21, further comprising a capscrew which secures to an end of said camshaft body for preventing the leakage of lubricant therefrom.

26. The camshaft of claim 25, further comprising a plug which is mounted on an end opposite said capscrew for preventing the leakage of lubricant therefrom.

27. The camshaft of claim 21, wherein said camshaft body is tapered at one end.

28. The camshaft of claim 21, wherein the diameter of said hollow interior is 47 percent of the diameter of said camshaft body.

* * * * *